United States Patent [19]

Honkaniemi et al.

[11] Patent Number: 4,708,640

[45] Date of Patent: Nov. 24, 1987

[54] APPARATUS FOR BATCH PREPARATION AND FEEDING INTO THE SMELTING PROCESS

[75] Inventors: Matti E. Honkaniemi; Lauri A. Mustikka; Martti J. Jankkila; Pentti O. Hokkanen, all of Tornio, Finland; Risto M. Heikkilä, Hasparanda, Sweden; Launo L. Lilja, Pori, Finland

[73] Assignee: Outokumpu Oy, Helsinki, Finland

[21] Appl. No.: 945,179

[22] Filed: Dec. 22, 1986

Related U.S. Application Data

[63] Continuation-in-part of Ser. No. 745,710, Jun. 17, 1985, abandoned.

[30] Foreign Application Priority Data

Jun. 27, 1984 [FI] Finland ..... 842577

[51] Int. Cl.[4] ..... F27B 15/00; F27D 1/08

[52] U.S. Cl. ..... 432/14; 432/99; 432/101; 414/147; 110/245

[58] Field of Search ..... 432/14, 99, 101; 222/146.2; 414/147; 110/245; 228/56

[56] References Cited

U.S. PATENT DOCUMENTS

| | | | |
|---|---|---|---|
| 2,964,308 | 12/1960 | Walde | 373/81 |
| 3,163,520 | 12/1964 | Collin et al. | 373/80 |
| 4,172,328 | 10/1979 | Escott et al. | 432/99 |
| 4,335,661 | 6/1982 | Stewart et al. | 110/245 |
| 4,349,969 | 9/1982 | Stewart et al. | 110/245 |
| 4,382,415 | 5/1983 | Korenberg | 110/245 |

*Primary Examiner*—Henry C. Yuen

*Attorney, Agent, or Firm*—McAulay, Fields, Fisher, Goldstein & Nissen

[57] ABSTRACT

The present invention relates to a method and apparatus for preparing a feed mixture, made of several batch components, at one stage in order to feed it into a smelting furnace. The preparation of the batch may include the preheating and drying of the material, the removal of crystal waters and evaporable substances as well as the conduction of the batch into the smelting furnace. According to the invention, a hot inert gas is conducted through a downwards settling batch so that the gas is mixed into the batch as well as possible, but even partial fluidization is prevented. The apparatus of the invention comprises a pretreatment silo (6) which is uniform at the upper part but is divided into several sub-silos (7) at the lower part. At the lower part of the sub-silos there are connected ducts (8) wherealong the batch flows into the smelting furnace (9) located below the pretreatment silo (6). In between the sub-silos (7) there is located the gas distribution chamber (34), wherefrom the gases are distributed through the distribution ducts (35) extending to the sub-silos and the gases are discharged at the top (41) of the silo (6). The employed gas is obtained by means of burning the exhaust gases (10) from the smelting furnace and by combining them with cleaned circulation gases (25).

16 Claims, 5 Drawing Figures

APPARATUS FOR BATCH PREPARATION AND FEEDING INTO THE SMELTING PROCESS

This application is a continuation-in-part of application Ser. No. 745,710, filed June 17, 1985, now abandoned.

The present invention relates to a method and apparatus for preparing a feed mixture which is composed of various different batch components and is often moist or cold, the preparation including for instance the mixing of various material constituents, drying, preheating and the removal of harmful evaporating substances, such as carbonates and crystal waters, as well as for feeding the prepared feed mixture into the smelting process, for example into an electric furnace process, so that it is divided into subflows in an optimal fashion. Naturally the preparation stage can, depending on the needs of each specific process, also comprise other procedures which are suitable with respect to the present method, for example prereduction.

A well-known method in the prior art has been to feed the raw material into an electric furnace from hoppers and silos located above the furnace by means of pipes which pass through the furnace roof, into the feed chutes extending to the inside of the furnace. In that case the consumption volume is defined by the settling rate of the feed material contained in the continuously full pipe work. The major drawback of this method is said to be the fact that the poisonous and easily burning carbon monoxide gases rise through the batch material contained in the feed pipework and are spread in the environment.

Another prior art method is the method protected by the Finnish Pat. No. FI 50028 which corresponds to U.S. Pat. No. 3,900,117, wherein the feeding is carried out by means of a gas-sealed feed ring arrangement.

Yet another prior art method is the method introduced in the Finnish Patent Application No. FI 753373 which corresponds to U.S. Pat. No. 4,001,488, wherein the electric furnace batch is divided by means of branching one of the outlet pipes from the silo and by specific adjusting means so that there is at least one feed pipe per each electrode. It is necessary to use check plates, because the method is based on the distribution of granular feed material undergoing free fall, and there is a considerable danger that the material would be sorted out.

In the prior art there is also known a method where granular material is distributed onto the surface of a sinking bed by means of a rotating feeder apparatus (U.S. Pat. No. 4,399,846). In the said patent, the feeding from the said feeder is carried out into an annular silo space which is continued by two more concentric nested annular silo structures, having downward broadening conical walls and which again are formed into several tubular flow ducts. The major object of the said method is to distribute the material so that each grain size is placed on the desired spot.

Furthermore, a method is known where the carbon monoxide produced in the electric furnace is burned, whereafter part of the exhaust gas is cleaned and conducted into the chimney, and part is returned to the combustion chamber and used for preheating steel scrap (U.S. Pat. No. 4,375,958).

Yet another method of the prior art is to feed and preheat granular material by means of utilizing gas which is burned either within the furnace or outside it (U.S. Pat. No. 3,459,411).

In the German Patent Application No. DE 2 900 078 which corresponds to U.S. Pat. No. 4,243,379, the above described method has been used for preheating two different materials in one and the same silo assembly so that the respective materials are kept apart for a sufficient length of time and that the hot preheating gases from the furnace are distributed for each material separately. At the bottom part of the silo assembly, the preheated materials are mixed and conducted into a kiln furnace.

Another German Patent Application, No. DE 2 339 254 which corresponds to Canadian Pat. No. 1,012,761, also uses gases from a kiln furnace for preheating granular material in a feed silo by means of a distributing the gas into the inside and outside of freely settling bed and by making use of the gas space left below the material distribution cones.

Before leading wet and in winter conditions even icy batch material into the melting process, the material must be dried and profitably preheating so that the evaporating constituents and crystal waters which are harmful with respect to the subsequent processes are simultaneously removed. A common procedure is to carry out the batch preparation and feeding into the furnace in several separate stages, which leads to immoderately high investment, operation and maintenance costs. Typical examples of pretreatment equipment are a kiln furnace or a band drier, in which case specific feeding assemblies with several silos are required in order to achieve continuous feeding.

An ordinary method for preventing the harmful gases from escaping from the furnace into the environment is to maintain a sufficient suction effect within the furnace. This is apparent particularly from the feeding methods based on free falling and settling, as is described above.

In a silo arrangement, the sorting out of material may often prove out to be a serious drawback, too—particularly if the drying and preheating is carried out by means of hot gases flowing through the bed. Moreover, it is difficult to make the gases spread evenly on the area of the whole silo bed, particularly when large feed silos are employed.

Consequently the object of the present invention is to prepare, dry and preheat the batch for the smelting process, as well as to remove the harmful evaporating substances and crystal waters and to feed the batch into the furnace in one and the same treatment assembly. For batch preparation, our method profitably utilizes the combustion gas resulting from the burning of CO-gases in the furnace; the temperature of the said combustion gas is regulated by means of a suitable inert gas, such as a circulating gas, while the conditions within the furnace space define the optimal gas demand. The feeding rate is adjusted by making use of the free settling of the silo bed. The essential novel features of the invention are apparent from the patent claim 1.

According to the present invention, the batch for a smelting furnace such as an electric furnace, for example lump ore, coal and quartz, are mixed in correct proportions, homogenized and fed into the top part of the drying and preheating silo. The batch feed onto the surface of the silo bed is arranged so that the agitation movements within the silo, the changes in the composition and settling rate of the bed, as well as the changes in the temperature and pressure conditions can be observed and, if necessary, adjusted by changing the location of the entering feed. The changing of the feeding spot and the continuous observation ensure an even bed surface, so that harmful sorting owing to the rolling of material remains as slight as possible.

In the top part of the silo, the feed mixture first settles down in a uniform bed and is later divided into several sub-flows, the combined cross-sectional area whereof is at first roughly equal to that of the topside uniform part.

The sub-flows are converged in a more or less conical form and are finally continued as cylindrical feed flows onto the surface of the bed in the furnace.

If a larger feed volume is needed at any specific spot of the furnace bed, this can be arranged for instance by increasing the cross-sectional area of the outlet of the respective sub-flow in the drying silo.

The required portion of the CO-gas from the smelting furnace, which is for instance an electric furnace, is burned while the air ratio is 1 or even below that if necessary, in the combustion chamber where an inert gas, advantageously circulating gas, can be mixed thereto for cooling, in order to achieve an oxygen-free pretreatment in case the batch contains some easily combustible material such as carbon. The rest of the CO-gas is directed to other operation purposes.

From the combustion chamber the combustion gas mixture, which is wholly or partly adjusted to the desired temperature by means of circulating gases, is conducted into the bottom part of the gas distribution chamber, and advantageously the gas enters the chamber in a tangential fashion.

If the process requires an increase in the gas volume or additional regulation of the gas temperature, the circulating gas is similarly conducted into this gas distribution chamber, advantageously somewhat above the combustion gas feed opening and in a radial fashion.

In the gas distribution chamber, the gas mixture which has reached its final composition and temperature, is divided into several branches, the number whereof is defined for example by the number of the sub-flows. The gas distribution chamber is located in a place which is advantageous with respect to heat economy, in the middle of the pretreatment silo, surrounded by the sub-flows. The gas distribution ducts lead radially out the gas distribution chamber. protected by the intermediate walls surrounded by the sub-flows.

From the gas distribution ducts, the gas is conducted into sub-silos (sub-flows) for instance through nozzles, the diameter whereof is sufficiently small in order to ensure that the gases are evently distributed on the bed. For example by changing the size or number of the nozzle pipes, the gas distribution in the various silos can also be regulated when desired. This necessity to regulate is affected, among other things, by the size and shape of each sub-silos, and possibly also by a differing need for heat caloric capacity on a specific part in the bed, as compared to other parts in the bed.

The gas flowing out of the nozzles spreads almost on the area of the whole bed due to the small cross-sectional area of the bottom parts of the sub-silos.

If the gas amount is large enough to create the danger that even part of the bed material may turn into fluidized state owing to too high a speed, part of the gas can be discharged from the top part of the gas distribution chamber through auxiliary nozzles into the sub-silo space, where the cross-sectional area already is so large, and where the first-fed gas has already somewhat cooled off, that there is no fear of fluidization.

The hot combustion gases rise through the above described settling mixture bed into the uniform part of the silo and further onto the bed surface. The gases leaving the bed surface and rising into the gas space located in the top part of the silo are conducted out to the silo in a flow as even as possible, in order to minimize the dust content.

The gases rising through the bed carry out the preheating and drying of the bed. Simultaneously the harmful evaporating substances and crystal waters of the batch are removed along with the gases, and the disturbances in the process itself are thus diminished. Thereafter the cooled and moistened gases are scrubbed and dried. Part of the gas is returned to circulate in the above described manner, and part is removed from the process.

The advantages of the present invention as compared to the prior art method are enlisted in the following:

The whole operation is carried out in one and the same unit, and not, as is customary, in a separate drier/-preheater (drying drum or equivalent), plus several silos and various feeders, and therefore the present invention is economical with respect to both operation and maintenance costs.

The apparatus of the present invention is stationary, e.g. it contains only a few moving parts, which is undoubtedly profitable in the long run.

The method of dividing the batch from the uniform silo into several sub-flows allows the hot pretreatment gas to be brought from inside the feed bed, which makes the distribution of the gas in the bed easier and improves the heat economy.

The method of dividing the batch from the uniform silo into several sub-flows, according to a principle resembling communicating vessels, allows for better chances to prevent any disturbances as compared to the use of separate individual silos, for example in the case where one quickly-settling sub-flow sinks down so much that the harmful gases are in danger to escape to the environment, and consequently the purpose of the present invention is to ensure secure operational circumstances.

The gases are conducted into the narrow space of the sub-flows, which allows the gas to be spread along the whole area of the bed.

The spreading of the gases along the whole area of the bed is made possible by employing auxiliary gas openings for regulation purposes in cases where the gas volume flowing from the feeding ducts results in a speed which is too high and thus favourable for fluidization.

The furnace gas can be utilized in the preparation of the bed

The circulating gas can be utilized as an inert gas.

The present invention is described below in more detail with reference to the appended drawings.

Figure 1:
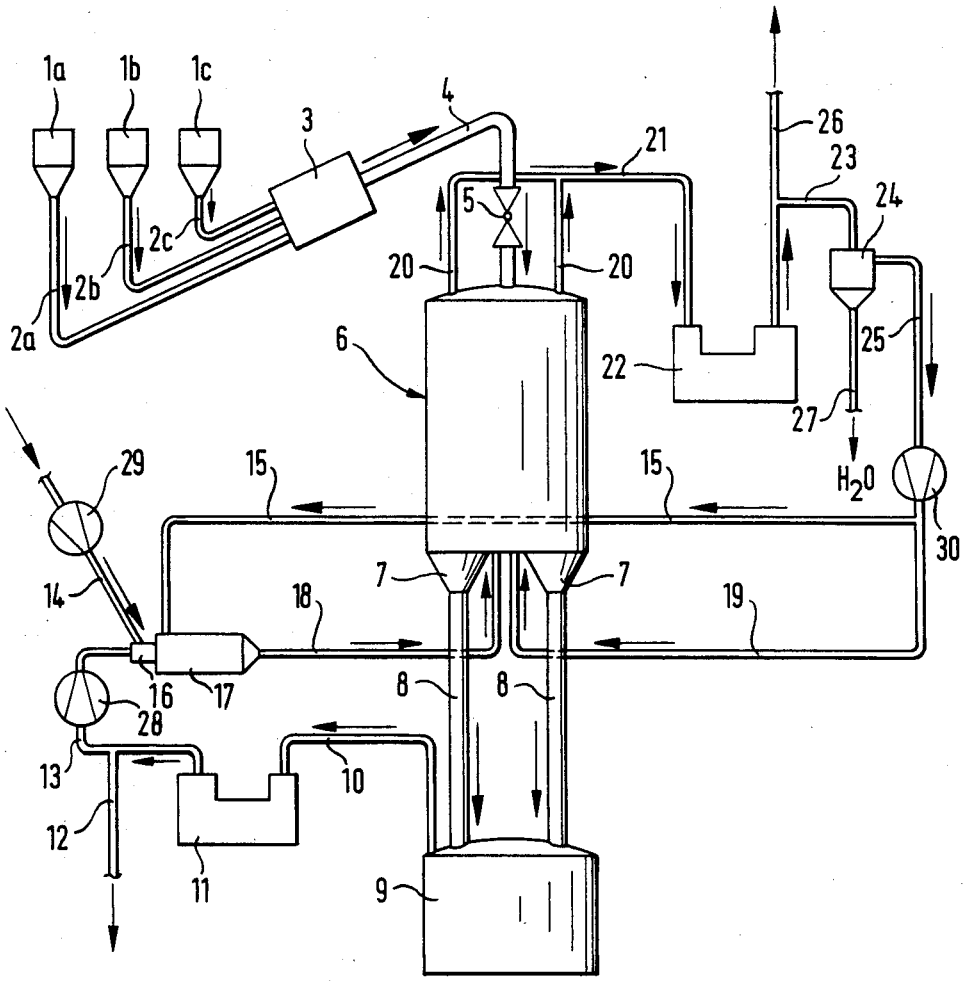
FIG. 1 is a schematical diagram of the process as a whole.

In FIG. 1, the numbers 1*a*, 1*b* and 1*c* refer to the storage silos of the various mixture components of the batch, from which storage silos the mixture 2*a*, 2*b* and 2*c* are conducted into the mixer and homogenizer unit 3 and subsequently further, in the form of the homogenized mixture 4, through the locking device 5 into the preparation silo 6 which is uniform at the top. The lower part of silo 6 is divided into several downwardly convergent sub-silos 7, along which the sub-flows are conducted down and further through the mainly tubular and vertical ducts 8, which are connected to the sub-silos 7, into the smelting furnace, which is for example an electric furnace 9. The CO-gases 10 flowing out of the smelting furnace are cleaned and if necessary cooled in the cleaner 11. Part of the CO-gas 12 is directed to other purposes, and the amount of CO-gas 13 required in the batch preparation is conducted, by means of the compressor 28, into the burner 16, where it is mixed with an amount of oxygen necessary for combustion which oxygen is mainly in the form of air 14, by means of the compressor 29. The well-mixed, combustible gas composition is burned in the combustion chamber 17, where an amount of circulating gas 15 can be added for cooling. The formed gas mixture 18 is conducted into the bottom part of the pretreatment silo 6, and particularly into the area defined by the sub-flow silos 7, i.e. into the gas distribution chamber, where an amount of circulating gas 19 is added thereto in order to regulate the gas temperature and volume. After passing through the silo 6, the gas which has now released heat and absorbed moisture as well as evaporable substances, is removed from the silo as evenly as possible, advantageously in several flows 20. The combined gas flows 21 are scrubbed clean of dust and other impurities in the scrubber 22. The portion 23 needed for batch preparation is dried in the drier 24 and conducted as dried gas 25 by means of the compressor 30 back into circulation and divided into the sub-flows 15 and 19 according to the above description. The residual gas 26 is removed from the process. The gases 27 left in the scrubber may be conducted into further treatment.

Figure 2:
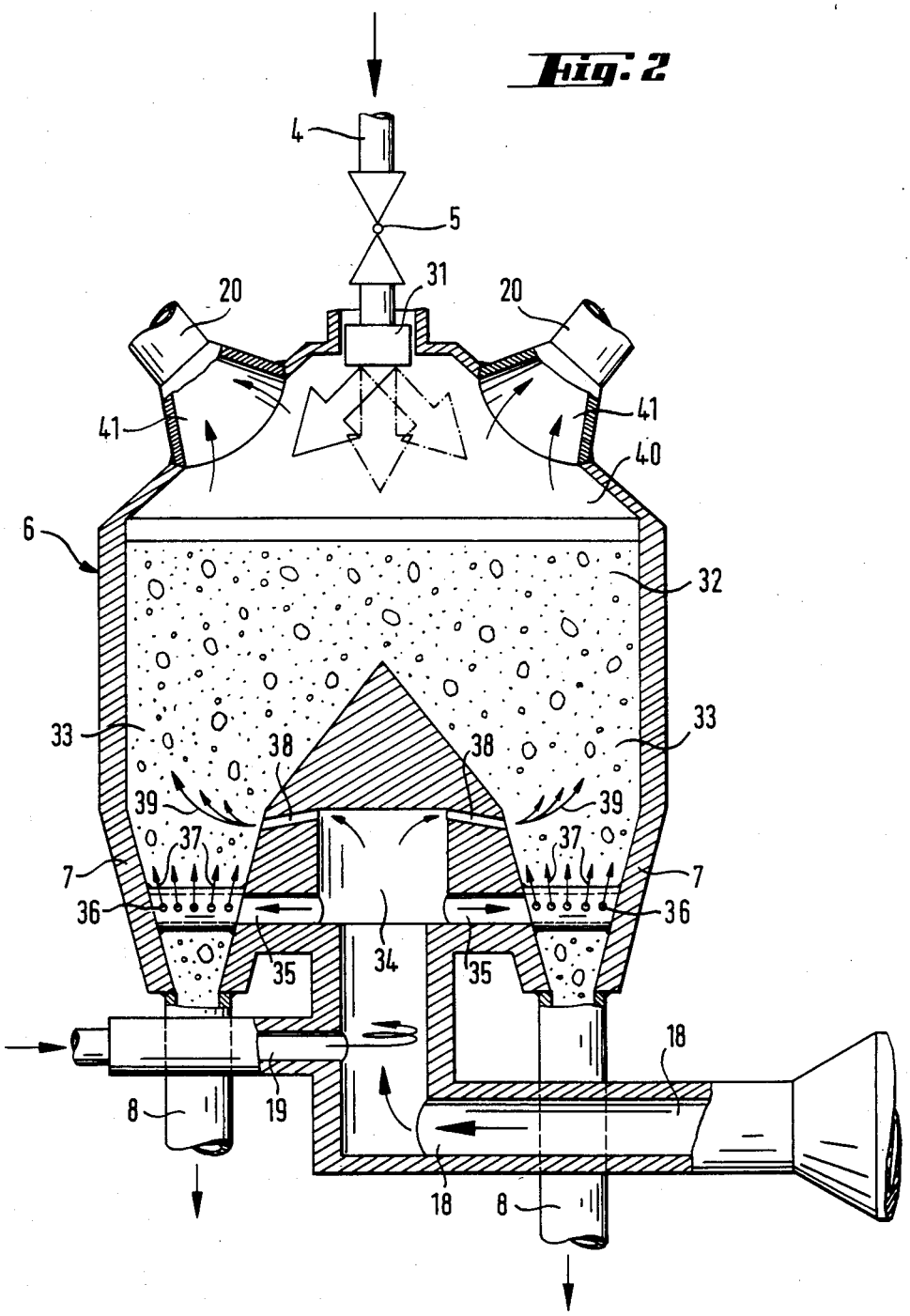
FIG. 2 is a partly schematical illustration in vertical cross-section of the most essential part of the apparatus of the present invention, i.e. the batch preparation silo.
Figure 3:
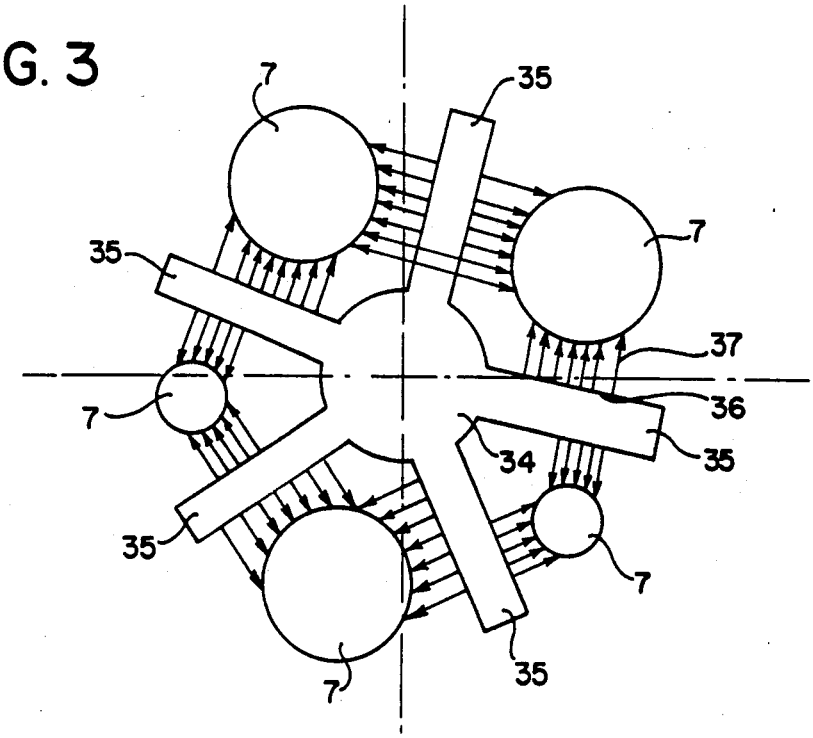
FIG. 3 is a cross-sectional view illustrating different size silos taken at the height of the gas distribution ducts.
Figure 4:
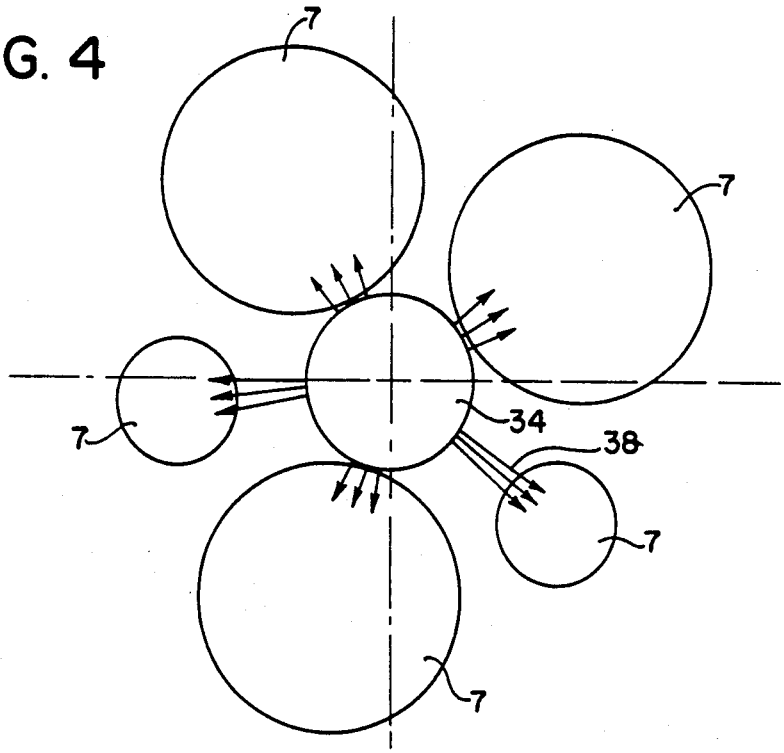
FIG. 4 is another cross-sectional view illustrating different size silos taken at the height of the regulations nozzles.
Figure 5:
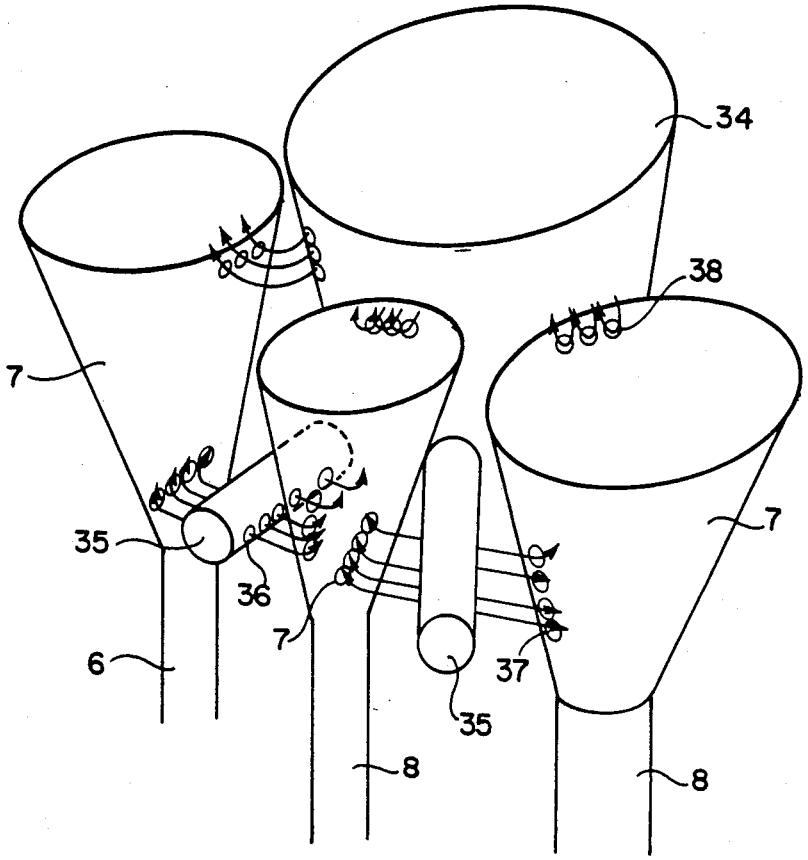
FIG. 5 is a perspective view illustrating dissimilar silos.

In FIG. 2, the number 4 refers to a homogenized batch to be prepared, which batch is fed, by means of a suitable distribution device 31, at a desired spot onto the surface of the uniform part 32 of the bed. The said feeding spot is defined, among other things, on the basis of a comparatively quick sinking effect at the bed surface, or on the basis of a change in the pressure or temperature at the bed surface. The bed settles down from the uniform part 32 into the sub-flows 33, the cross-sectional area whereof gradually decreases from as far as the beginning of the mainly cylindrical ducts 8 leading to the smelting furnace. The hot combustion gas 18 which is possibly already somewhat cooled off by means of circulating gas is conducted into the gas distribution chamber 34, advantageously to the bottom part of the said chamber in a tangential fashion. Into the same chamber 34, and similarly advantageously to the bottom part thereof, there is conducted the rest of the circulating gas 19 in a radial fashion somewhat above the combustion gas 18. In the gas distribution chamber 34, the combustion gas and the circulating gas are mixed, whereafter the gas mixture, the temperature whereof is thus adjusted to be the desired final temperature, is conducted into the gas distribution ducts 35 which are directed towards the sub-flows 33. Because the gas distribution chamber 34 is surrounded by the sub-silos 7 and consequently also by the sub-flows 33, the said distribution ducts are directed radially outwards from the chamber. In addition to this the ducts proceed protected by the surrounding walls of the sub-flows and in the vicinity of the narrowest spot of the subflows. The gas sprays 37 discharged through the discharge nozzles 36 of the distribution ducts 35 are spread along the cross-sectional area of the settling bed, and rise further into the bed simultaneously releasing heat and absorbing moisture therefrom. If the requirements for the gas capacity are so high that excessive flowing rates are created at the bottom part of the bed, it is necessary to allow part of the gases to be discharged through the auxiliary nozzles, or regulating nozzles 38 which are located at the upper part of the gas distribution chamber and directed more or less radially therefrom. The gas sprays 39 discharged through the said auxiliary nozzles are let out at such a spot where the cross-sectional area of the sub-flows 33 is larger that at the spot where the gas sprays 37 are discharged, so that the danger of fluidization is eliminated, particularly so because the gases rising from below are already diminished in volume owing to their cooling off. The size of the openings in the auxiliary nozzles 38 can be fixed, or it can be adjustable during the operation. The gases which have thus carried out the preparation of the batch, are discharged from the space 40 located above the bed surface in a flow as even as possible, advantageously through two or more outlets 41 in order to minimize the amount of outcoming dust.

The sub-silos 7 may be different in size and have cross-sectional areas which are dissimilar in size from each other.

EXAMPLE 1

According to FIG. 1, an amount of CO-gas (13) (CO—88%, $H_2$—2%, $CO_2$—2%, $H_2O$—4%, $N_2$—4%) was burned while the air ratio was 1. The resulting combustion gas was cooled off down to the temperature of 800° C. by means of an inert gas (25) ($CO_2$—35%, $H_2O$—2%, $N_2$—62%) which was separated from the exhaust gas produced in the drying silo of the invention and returned into circulation after scrubbing and dehydration.

The amount of the said circulating gas was regulated by means of compressors (30), on the basis of the set value (800° C.) of the temperature in the distribution chamber (34) and a respective measurement. The amount of the said circulating gas (25) (50° C.) employed for the temperature and volume adjustments was 6.4-fold compared to the CO-gas.

The analysis of the gas adjusted for the batch preparation was changed only little with respect to the circulating gas, i.e. it was $CO_2$—35%, $H_2O$—2%, $N_2$—63%.

The feeding of the batch (4) to be prepared was carried out continuously. The batch contained lump ore, coal and quartz. In the examples all amounts are given per one ton of batch. The respective moisture and crystal water contents in the batch were 33 and 20 kg/1000 kg.

The batch was heated up to the temperature of 650° C. in the above described fashion by burning CO-gas (13) 83 $m^3$ (NTP/100 kg batch, and by employing circulating gas (25) 531 $m^3$ (NTP)1000 kg batch for regulation. Of the total amount of heat released from the gases, 65% was spent in heating up the batch, 21% was spent in evaporating moisture, in removing crystal waters and in calcinating, and 6% was spent in heat losses, while 9% of the heat was left in the exhaust gas (100° C, $CO_2$—33%, $H_2O$—10%, $N_2$—57%).

The amount of water removed from the exahust gas was 52 kg/1000 kg batch and about 70% of the gas was returned to circulation.

EXAMPLE 2

In the pretreatment silo (6) according to FIG. 2, there was treated a continuously fed batch containing lump ore, coal and quartz. In the batch, the grain size of coal was finest (50% 17.5 mm and 84% 22.5 mm). The volume of the gas discharged from the gas distribution chamber (34) through the nozzles (36) was such that in this experimental case it created a gas speed of 5.32 m/s in the silo at the said discharge spot of the nozzles, calculated for an empty silo. When the batch was analyzed after the outlet of the drying silo it was observed that the coal content, as compared to the coal content in the feed was diminished 50 . . . 60%. The gas speed was dropped down to 3.6 m/s by conducting 30% of the gas into the silo through the auxiliary upper openings (38). Now the concentration of coal in the bed was stopped and the coal content measured from the silo discharge pipes was equal to the coal content in the feed. In further investigations it was found out that the excessive speed of the gas, owing to fluidization properties, resulted in the formation of a plug for the coal at the narrowest spot of the silo. The critical speed area where the plug formation was stopped was comparatively narrow, wherefore the procedure of conducting part of the gas through a wider path in the upper part of the silo helped rather quickly.

We claim:

1. An apparatus for preparing a feed mixture to be fed into a smelting furnace within one unit, comprising:

pre-treatment apparatus for the feed mixture comprising a pre-treatment silo having a uniform upper part for feeding the material thereinto in a downwardly direction and a lower part, said lower part being divided into several individual, separate downwardly conically divergent sub-silos to produce sub-flows in an upward direction;

vertical ducts coupling the bottom end of said sub-silos leading to said smelting furnace, said smelting furnace being located below said pre-treatment apparatus;

a gas distribution chamber surrounded by said individual, separate sub-silos for positioning said gas distribution chamber between or within the periphery formed by said individual, separate sub-silos;

gas distribution ducts leading from said gas distribution chamber in a direction transverse to and radially of said material feed towards said sub-silos, said ducts being provided with discharge nozzles directed transversely from said gas distribution ducts and in an upward manner towards a conically convergent region of each of said sub-silos; and at least one gas outlet at the upper part of said pre-treatment silo.

2. The apparatus of claim 1, wherein the upper part of said gas distribution chamber is provided with regulation nozzles which are directed towards said sub-silos in a mainly radial fashion.

3. The apparatus of claim 2, wherein the crosssectional areas of said sub-silos are dissimilar in size.

4. The apparatus of claim 2, including means for conducting circulating gas in a radial fashion into said gas distribution chamber.

5. The apparatus of claim 1, wherein the cross-sectional areas of said sub-silos are dissimilar in size.

6. The apparatus of claim 5, including means for conducting circulating gas in a radial fashion into said gas distribution chamber.

7. The apparatus of claim 1, including means for conducting hot combustion gases transversely to said vertical ducts into said gas distribution chamber.

8. The apparatus of claim 7, including means above said hot combustion gas conducting means for conducting circulating gas in a radial fashion into said gas distribution chamber.

9. The apparatus of claim 1, including means for conducting circulating gas in a radial fashion into said gas distribution chamber.

10. The apparatus of claim 1, wherein said gas distribution ducts leading out of said gas distribution chamber are protected by intermediate walls surrounding said sub-flows.

11. An apparatus for preparing a feed mixture to be fed into a smelting furnace within one unit, comprising:

pre-treatment apparatus for the feed mixture comprising a pre-treatment silo having a uniform upper part for feeding the material thereinto in a downwardly direction and a lower part, said lower part being divided into several downwardly conical divergent sub-silos to produce sub-flows in an upward direction;

vertical ducts coupling the bottom end of said sub-silos leading to said smelting furnace, said smelting furnace being located below said pre-treatment apparatus;

a gas distribution chamber surrounded by said sub-silos for positioning said gas distribution chamber within the periphery formed by said sub-silos;

gas distribution ducts leading from said gas distribution chamber in a direction transverse to and radially of said material feed towards said sub-silos, said ducts being provided with discharge nozzles directed transversely from said gas distribution ducts and in an upward manner towards a conically divergent region of said sub-silos; and at least one gas outlet at the upper part of said pre-treatment silo.

12. The apparatus of claim 11, wherein the upper part of said gas distribution chamber is provided with regulation nozzles which are directed towards said sub-silos in a mainly radial fashion.

13. The apparatus claim 11, wherein the cross-sectional areas of said sub-silos are dissimilar in size.

14. The apparatus of claim 11, including means for conducting hot combustion gases transversely to said vertical ducts into said gas distribution chamber.

15. The apparatus of claim 11, including means for conducting circulating gas in a radial fashion into said gas distribution chamber.

16. The apparatus of claim 15, wherein said circulating gas conducting means is above said hot combustion gas conducting means.

* * * * *